United States Patent [19]

Congdon

[11] Patent Number: 5,005,230

[45] Date of Patent: Apr. 9, 1991

[54] PATIENT TRANSPORTER

[75] Inventor: Richard G. Congdon, Providence, R.I.

[73] Assignee: Massachusetts Eye and Ear Infirmary, Boston, Mass.

[21] Appl. No.: 502,448

[22] Filed: Mar. 30, 1990

[51] Int. Cl.[5] ..... A61G 7/00; A61G 7/05

[52] U.S. Cl. ..... 5/60; 5/308; 5/423; 5/508

[58] Field of Search ..... 5/60, 423, 58, 308, 5/508, 81 R, 81 B; 269/322-328

[56] References Cited

U.S. PATENT DOCUMENTS

| | | | |
|---|---|---|---|
| 1,327,941 | 1/1920 | Camp | 5/58 |
| 2,093,834 | 9/1937 | Gaugler | 5/423 |
| 2,100,322 | 11/1937 | Dailey | 5/507 |
| 2,290,615 | 7/1942 | Firestone | 5/308 |
| 4,504,992 | 3/1985 | Herron et al. | 5/507 |
| 4,768,241 | 9/1988 | Beney | 5/60 |

FOREIGN PATENT DOCUMENTS

| | | | |
|---|---|---|---|
| 845 | 4/1901 | United Kingdom | 5/348 |

*Primary Examiner*—Alexander Grosz
*Attorney, Agent, or Firm*—Fish & Richardson

[57] ABSTRACT

A patient-transporting system including a combined transport stretcher/operating room table, means for securely transporting medications and medical records, and a patient-jumpsuit. The means for securely transporting medications and medical records is mounted on the combined transport stretcher/operating room table.

5 Claims, 2 Drawing Sheets

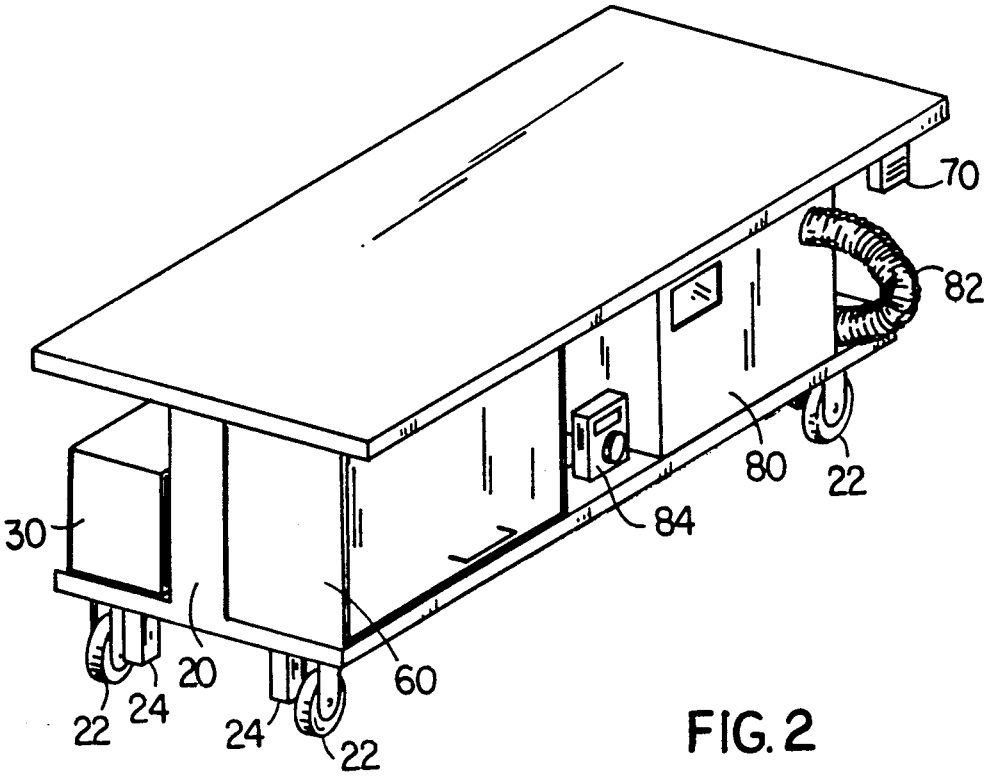
FIG. 2
FIG. 3
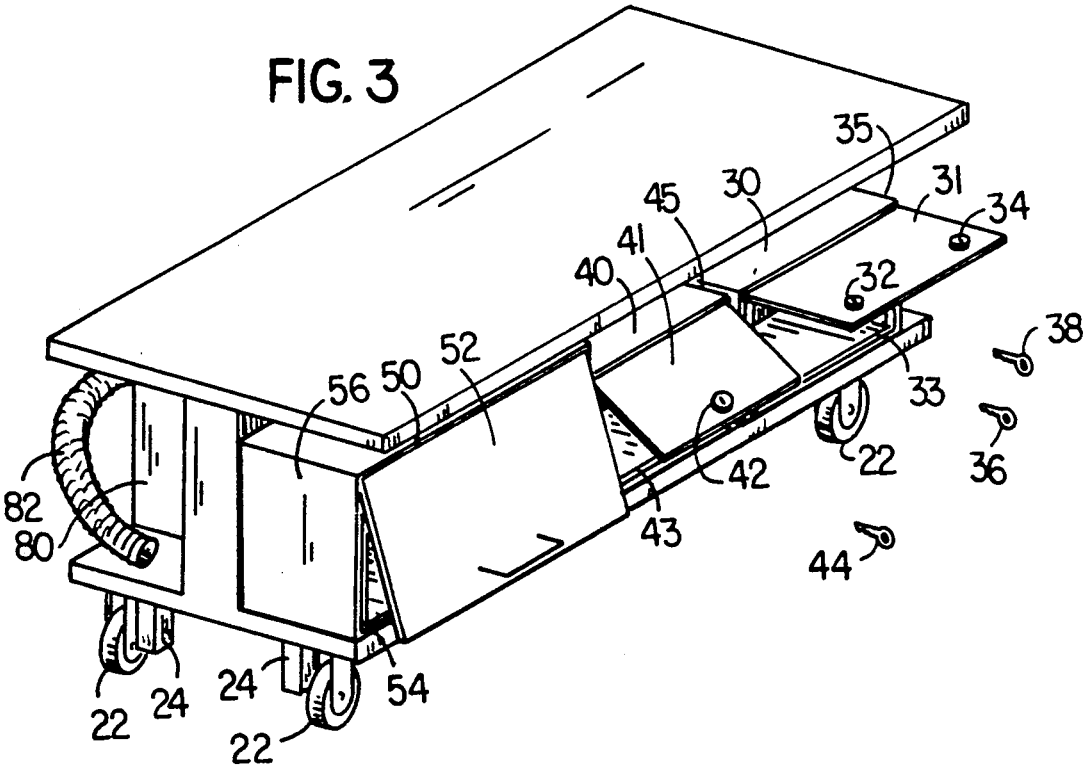

PATIENT TRANSPORTER

BACKGROUND OF THE INVENTION

This invention relates to a patient-transporting system.

Hospitals and clinics with large outpatient surgery populations face a number of problems in the management and movement of patients. Of primary importance is the rapid movement of patients to and from surgery. Additionally, the movement of patient-belongings, medical records, medications, and visitors must be provided for in a way that is economical but yet assures that these items are present when needed. Current approaches to outpatient management require considerable investment of hospital resources yet still do not result in consistently rapid and efficient movement of patients from the point of intake to the point of discharge.

SUMMARY OF THE INVENTION

In general, the invention features a patient-transporting system including a combined transport stretcher-/operating room table, means for securely transporting medications and medical records, and a patient-jumpsuit. The means for securely transporting medications and medical records is mounted on the combined transport stretcher/operating room table.

In preferred embodiments the patient-transporting system includes means for carrying patient belongings mounted on the combined transport stretcher/operating room table.

In preferred embodiments the patient-transporting system includes means for securely transporting patient valuables mounted on the combined transport stretcher-/operating room table.

In preferred embodiments the patient-transporting system includes means for summoning a patient escort.

In preferred embodiments the patient-transporting system includes means for supplying heated and cooled air to the patient jumpsuit. The means for supplying air is mounted on the combined transport stretcher/ operating room table.

In preferred embodiments patient-transporter of the invention includes the following: a transport stretcher-/operating room table which is equipped with wheels and retractable legs and which possesses surfaces upon which equipment can be mounted; a garment container, fabricated from a durable, washable, and easily sterilized material, which is airtight when closed; a boot container, fabricated from a durable, washable and easily sterilized material, which is airtight when closed; a personal effects container, fabricated from a durable, washable and easily sterilized material, which is airtight when closed, which is locked by a first lock and a second lock, and which cannot be removed from the transport stretcher/operating room table when closed and locked; a medication and medical records container fabricated from a sturdy washable and easily sterilized material, which is airtight when closed, which is secured by a third lock, and which cannot be removed from the transport stretcher/operating room table when closed and locked; a radio pager; a patient-jumpsuit which includes an opening for patient entry, an air entry port, and an air exhaust vent covered with HEPA filter material; and a personal heating and air conditioning unit which includes a conduit to deliver air to the patient-jumpsuit, a rechargeable power source, and a heating and an air-conditioning module.

In another aspect the invention features a disposable patient-jumpsuit including an opening for patient entry, an air entry port, and an air exhaust vent covered with HEPA filter material.

The patient-transporting system of some embodiments provides a comprehensive system for the management of ambulatory surgical patients, patient-belongings, medical records, medications, and visitors. The patient-transporting system of some embodiments increases efficiency in hospital operations, particularly in outpatient or ambulatory surgery, by reducing traffic and conserving time, space, and labor. The patient-transporting system of some embodiments increases the security of patient-belongings, medical records, and medications.

The patient-transporting system of some preferred embodiments provides secure and efficient movement of the patient, the patient's personal effects, medications, and medical records from the point of intake to the point of discharge in ambulatory surgery. The patient's belongings are carried on the patient-transporting system, with the patient, throughout the patient's stay in the hospital. This contributes to a reduction in traffic flow by eliminating a trip by the patient to retrieve his or her belongings. It also increases efficiency by eliminating the need for a storage area for the belongings and by eliminating or minimizing the involvement of hospital personnel in the collection, storage, and disbursement of patient-belongings.

In some embodiments security for the patient's belongings is increased by the elimination of hospital personnel from the process and by the provision of a locked container for patient-valuables. Two keys are necessary to open the container in which the patient's personal effects are stored. One key is held by the patient and the other is held by hospital personnel. Thus the personal effects container cannot be opened e.g., by an unauthorized individual who takes a key from the person of an anesthetized patient.

Medical records and medications are carried on the patient-transporting system, insuring easy access to these items by health care providers. The medical records and medications container can be locked. Only health care providers carry copies of the key, insuring the confidentiality and security of the contents. One key opens the medical records and medication container of all patient-transporters used in a hospital, thus the number of keys a health care specialist must carry is minimized.

The patient-transporting system of some embodiments reduces contamination of hospital environment from organisms or debris shed by the patient or by patient-belongings. Patient- belongings are stored in airtight, washable, easy to sterilize containers to prevent contamination of hospital environments with microorganisms, macroorganisms, or other debris. Contamination, of the containers is minimized by placing the patients outerwear and footgear in disposable plastic bags prior to placing them in the containers. Contamination of hospital environments by organisms or other debris shed by the patient is minimized by the patient-jumpsuit.

The patient-jumpsuit eliminates the need for the patient to disrobe, store his or her clothes, and don a surgical gown prior to surgery. Likewise it eliminates the need for the patient to retrieve his or her clothes and dress after surgery. Instead, the patient dons a disposable jumpsuit connected to a patient-controlled personal heating and air-conditioning unit. The patient jumpsuit also protects the patient's clothing from damage by solutions used in surgery and, together with the personal heating and air conditioning (PHAC) unit, increases patient comfort.

The patient-transporting system functions both as a stretcher/transporter and as an operating room table. Transfer of the patient from a stretcher or wheelchair to the operating room table and back to a stretcher or wheelchair after surgery is thus eliminated. This feature results in an additional savings in time and labor.

The patient-transporting system of some embodiments simplifies reuniting the patient with escorts or visitors after treatment. A signal to the pager (carried by the escort or visitor) assigned to a patient-transporter instructs the escort or visitor to meet with the patient at a pre-determined location.

After use by a patient the patient-transporting system is rapidly and easily recycled for use by another patient.

Other features and advantages will become apparent from the following description of the preferred embodiment, and from the claims.

DESCRIPTION OF THE PREFERRED EMBODIMENT

The drawings will first be briefly described.

Drawings

FIG. 2 is a ¾ view of the back and left side of the transport stretcher/operating room table and some of its accessory components; and FIG. 3 is a ¾ view of the front and right side of the transport stretcher/operating room table and some of its accessory components.

Structure

Figure 1:
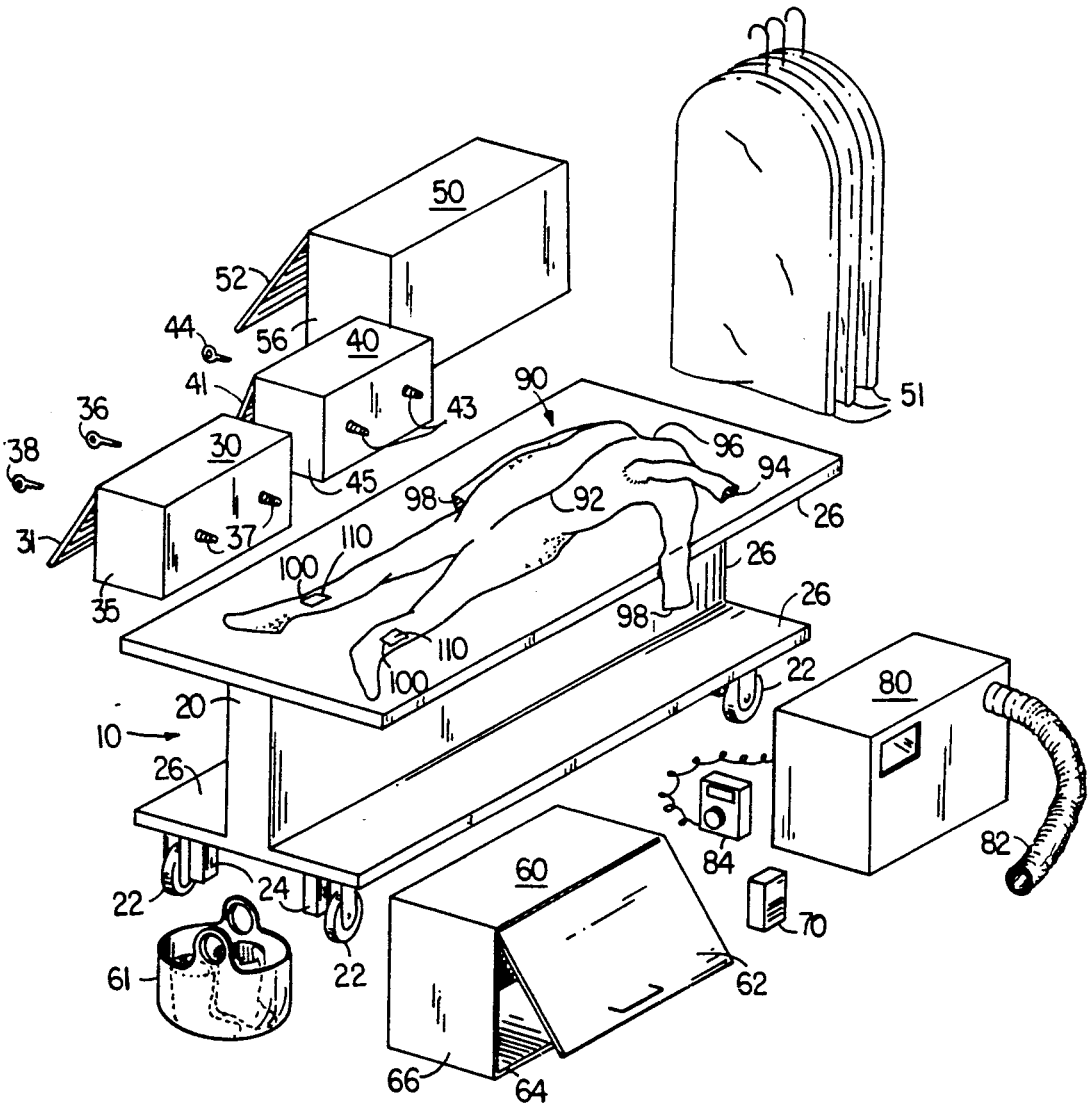
FIG. 1 is an exploded view of the preferred embodiment.

Referring to FIGS. 1, 2, and 3, the patient-transporting system 10 comprises a transport stretcher/operating room table 20, a personal effects container 30, a medication and medical records container 40, a garment container 50, 3 disposable plastic garment bags 51, a boot container 60, a disposable plastic boot bag 61, a pager 70, a personal heating and air-conditioning (PHAC) unit 80, and a patient-jumpsuit 90.

The transport stretcher/operating room table 20 is equipped with wheels 22 to allow easy movement between various points in the hospital. Retractable legs 24 can be lowered to render the transporter stable and immobile for use as an operating room table. Alternatively, the wheels of the transport stretcher/operating room table can be equipped with locking brakes that render it immobile and stable when the brakes are applied. The transport stretcher/operating room table 20 possesses surfaces 26 upon which the personal effects container 30, medication and medical records container 40, garment container 50, boot container 60, pager 70, PHAC unit 80, and other auxilliary equipment are mounted.

The personal effects container 30 is constructed of a durable, washable, and easily sterilized material, e.g., ABS plastic. The personal effects container is secured to the transport stretcher/operatingroom table in such a way that it cannot be easily removed when the personal effects container is locked, e.g. by bolts or screws 37 that are accessable only when the personal effects container is unlocked. The personal effects container 30 is locked by two locks, a patient lock 32 and a hospital lock 34. Each lock is separately keyed. The key 36 to the patient lock 32 will open only the patient lock 32 on that patient's transporter. The hospital lock 34 is opened by a hospital lock key 38 which is common to the hospital lock on the personal effects container of all patient-transporters in the hospital. When closed, the lid 31 of the personal effects container, by means of a gasket 33 of neoprene or a similar material, forms an airtight seal with the body 35 of the personal effects container.

The medication and medical records container 40 is fabricated from a sturdy, washable, and easily sterilized material, e.g., ABS plastic. The medication and medical records container is secured to the transport stretcher-/operating room table in such a way that it cannot be easily removed when the medication and medical records container is locked, e.g., by bolts or screws 43 that are accessible only when the medication and medical records container is unlocked. The medication and medical records container 40 is secured by one lock 42. A single key 44 opens the medication and medical records containers on all patient-transporters. When closed, the lid 41 of the medical records container, by means of a gasket 43 of neoprene or a similar material, forms an airtight seal with the body 45 of the medication and medical records container.

The garment container 50 is fabricated from a durable, washable, and easily sterilized material, e.g., ABS plastic. When closed, the lid 52, by means of a gasket 54 of neoprene or a similar material, forms an airtight seal with the body 56 of the garment container.

The boot container 60 is fabricated from a durable, washable, and easily sterilized material, e.g., ABS plastic. When closed, the lid 62 of the boot container, by means of a gasket 64 of neoprene or a similar material, forms an airtight seal with the body 66 of the boot container.

The pager 70 is a standard radio pager (Motorola Corp., Chicago, Ill.). A pager is assigned to a single transporter. The pager is mounted on the transport stretcher/operating room table in a way that allows easy removal of the pager.

The patient-jumpsuit 90 is fabricated from Tyvec or a similar material that can easily be cut in case health care providers need greater access to the patient. The patient jumpsuit can be fabricated from disposable protective clothing used in the chemical, pharmaceutical, or drug industries. The patient-jumpsuit includes a zippered or Velcro secured opening 92 for patient entry, an air entry port 94, and air exhaust vents 100. The collar 96 and cuffs 98 of the patient-jumpsuit fit snugly to prevent the escape of supplied air. The relative positions of the air entry port 94 and the air exhaust vents 100 are chosen to assure good circulation of air throughout the patient-jumpsuit and to direct exhaust away from the surgical field. Where the surgical field is the head, the air intake port 94 is positioned near the chest or shoulders and the exhaust vents 100 placed near the feet. The air exhaust vents 100 are covered with a high efficiency particle arresting (HEPA) filter 110 to prevent the distribution of organisms and other debris. Preferably the filter has a pore size of between $0.3\mu$ and $1.0\mu$ and is approximately 95% efficient at a $0.3\mu$ particle size. The cross-sectional area of a HEPA filter covered air exhaust vent is chosen to match exhaust flow from the air exhaust vent with the input flow from the PHAC unit.

The PHAC unit 80 supplies heated or cooled air to the patient-jumpsuit 90 by means of the conduit 82 connected to the air input port 94 of the patient-jumpsuit 90. Regulation of the PHAC unit 80 is under the control of the patient and is effected through the PHAC control unit 84. The PHAC unit 80 contains its own rechargeable power source and may be used to power other equipment carried on the transporter. The M10 Microclimate Unit (CKT Corp. Bridgeport, Conn.) is a suitable PHAC unit for use on the transporter of the invention.

Operation

Upon intake the patient is taken to a patient-transporting unit. The patient's valuables are placed in the personal effects container and both locks are locked. The patient is given a key to the patient lock. This key will operate only the lock on the patient's transporter. Keys to the hospital lock are held by hospital personnel at the points of intake and discharge. The hospital key will open the hospital lock of the personal effects container on all patient-transporting systems in the hospital. Both the hospital key and the patient key are required to open the personal effects container.

The patient places bulky outerwear such as winter coats or rain gear in disposable plastic garment bags and places the bagged garments in the garment container. The garment bags prevent contamination of the garment container. The lid of garment container is closed and the airtight seal between the lid and the container prevents the release of microorganisms, or macroorganisms, and other debris from the patient's garments. If the patient is wearing boots or heavy shoes these are placed in a disposable plastic boot bag and the bagged items placed in the boot container. Bagging the boots or shoes prevents contamination of the boot container. The lid of the boot container is closed and the airtight seal between the lid and the container prevents the release of microorganisms, or macroorganisms, and other debris from the patient's footgear. If an escort or visitor accompanies the patient, his or her outerwear and boots may also be placed in the appropriate containers.

Medical records, medications, and other items which may be needed by health care providers are placed in the medication and medical record container and the container locked. Copies of a key which can open the medication and medical records container of any of the hospital's transporters are carried by the appropriate health care providers.

The patient then dons the patient-jumpsuit, the PHAC unit is activated and connected to the jumpsuit, and the patient is given the PHAC unit control. The patient controls the temperature and air flow with the PHAC control unit. If the patient is accompanied by a visitor or escort that person is given the pager and instructed to meet the patient at the appropriate location when the pager is signaled. The patient mounts the transport stretcher/operating room table and is taken to the next destination.

Where immobile stable support, e.g. in the operating room, is needed, the retractable legs of the transport stretcher/operating room table are lowered.

Upon completion of the patient's treatment the patient is moved, on the patient transporting-system, to the discharge area. Any escort or visitor is summoned by a signal to the pager and the patient retrieves his belongings from the various containers.

Little effort is involved in recycling the patient-transporting system for use by a subsequent patient. The pager is placed back on the transport stretcher/operating room table and, if needed, the patient-transporter is cleaned and the PHAC unit recharged.

Other embodiments are within the following claims.

What is claimed is:

1. A patient-transporting stretcher/operating room table system incorporating a plurality of components for the comfortable, secure, and efficient movement of an outpatient or ambulatory surgical patient and his belongings comprising (a) a combined transport stretcher/operating room table mounted on wheels;

(b) one or more lockable containers;

(c) a patient-jumpsuit; and (d) a means for supplying heated and cooled air to said patient jumpsuit, wherein said lockable containers and said means for supplying air are mounted on said combined transport stretcher/operating room table.

2. The patient-transporting system of claim 1 further comprising means for carrying patient belongings, said means for carrying patient belongings being mounted on said combined transport stretcher/operating room table.

3. The patient-transporting system of claim 1 further comprising means for securely transporting patient valuables, said means for securely transporting patient valuables being mounted on said combined transport stretcher/operating room table.

4. The patient-transporting system of claim 1 further comprising means for summoning a patient escort.

5. A patient-transporting stretcher/operating room table incorporating a plurality of components for the comfortable, secure, and efficient movement of an ambulatory surgical patient or outpatient and his belongings comprising (a) a combined transport stretcher/operating room table equipped with wheels and retractable legs and which possesses surfaces upon which equipment can be mounted;

(b) means for carrying patient-belongings comprising (i) a garment container fabricated from a durable, washable and easily sterilized material, which is airtight when closed, (ii) a boot container fabricated from a durable, washable and easily sterilized material, which is airtight when closed, (c) a lockable container for securely transporting patient-valuables fabricated from a durable, washable and easily sterilized material, which is airtight when closed, which is locked by a first lock and a second lock, and which cannot be removed from said transport stretcher/operating room table when closed and locked;

(d) a lockable container for securely transporting medications and medical records fabricated from a sturdy, washable, and easily sterilized material, which is airtight when closed, which is secured by third lock, and which cannot be removed from said transport stretcher/operating room table when closed and locked;

(e) a radio pager for summoning a patient-escort;

(f) a patient-jumpsuit comprising an opening for patient entry, an air entry port, and an air exhaust vent covered with HEPA filter material; and (g) a personal heating an air-conditioning unit comprising a conduit to deliver air to said patient-jumpsuit, a rechargeable power source, and a heating and an air-conditioning module, wherein said means for carrying patient-belongings, said lockable container for securely transporting patient-valuables, said lockable container for securely transporting medications and medical records, said radio pager, and said personal heating and air-conditioning unit are mounted on said combined transport stretcher/operating room table.

* * * * *